US010604380B2

(12) United States Patent
Blondel et al.

(10) Patent No.: US 10,604,380 B2
(45) Date of Patent: Mar. 31, 2020

(54) ELEVATOR CAR

(71) Applicants: Otis Elevator Company, Farmington, CT (US); Stephane Blondel, Gien (FR)

(72) Inventors: Stephane Blondel, Gien (FR); Etienne Beaubois, Gien (FR); Romain Durand, Gien (FR); Frederic Bourassin, Gien (FR); Paul Guillaume, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/555,771

(22) PCT Filed: Mar. 5, 2015

(86) PCT No.: PCT/EP2015/054645
§ 371 (c)(1),
(2) Date: Sep. 5, 2017

(87) PCT Pub. No.: WO2016/138963
PCT Pub. Date: Sep. 9, 2016

(65) Prior Publication Data

US 2018/0037440 A1 Feb. 8, 2018

(51) Int. Cl.
*B66B 11/02* (2006.01)
*B66B 13/30* (2006.01)

(52) U.S. Cl.
CPC ..... *B66B 11/0233* (2013.01); *B66B 11/0226* (2013.01); *B66B 13/30* (2013.01)

(58) Field of Classification Search
CPC .. B66B 11/0233; B66B 11/0226; B66B 13/30
See application file for complete search history.

(56) References Cited

U.S. PATENT DOCUMENTS 1,857,913 A * 5/1932 Judelson ..... E04H 1/14 52/262
2,614,664 A * 10/1952 Sherron ..... E04H 1/14 52/262

(Continued)

FOREIGN PATENT DOCUMENTS

CN 202144417 U 2/2012
EP 721912 A2 * 1/1996

(Continued)

OTHER PUBLICATIONS

Chinese First Office Action and Search Report for application CN 201500774679, dated Aug. 28, 2018, 10 pages.

(Continued)

*Primary Examiner* — Michael A Riegelman
(74) *Attorney, Agent, or Firm* — Cantor Colburn LLP

(57) ABSTRACT

An elevator car (2), which is configured for moving along a hoistway in a vertical direction, comprises a passenger compartment defining an interior space (4) surrounded by sidewalls and at least one car door, said sidewalls (62, 63, 64) and/or said car door forming at least one vertically extending corner or protrusion (7). At least one vertically extending decorative element (13, 16) is assigned to the at least one vertically extending corner or protrusion (7) and comprises at least one vertically extending lighting element (10) which is configured for illuminating the interior space 4.

8 Claims, 7 Drawing Sheets

(56) References Cited

U.S. PATENT DOCUMENTS 2,648,409 A * 8/1953 Daugherty ..... A47K 3/284 52/264
3,675,379 A * 7/1972 Lambert ..... E04B 1/08 52/264
5,412,542 A * 5/1995 Mandy ..... B66B 11/0233 187/390
5,725,201 A * 3/1998 Parth ..... E04C 2/20 160/235
5,842,545 A * 12/1998 Blaiotta ..... B66B 11/0253 187/401
5,862,889 A * 1/1999 Sevilleja ..... B66B 1/466 187/395
5,889,241 A * 3/1999 Zambelli ..... B66B 3/02 187/391
5,975,249 A * 11/1999 Tomaseti ..... B66B 11/0226 187/401
6,834,468 B1 * 12/2004 Kroie ..... B32B 15/12 52/309.9
2003/0006102 A1 * 1/2003 Bloch ..... B66B 11/0233 187/414
2006/0175148 A1 * 8/2006 Starace ..... B66B 11/0206 187/401
2006/0215399 A1 * 9/2006 Endo ..... B66B 11/0233 362/231
2007/0181383 A1 * 8/2007 Bizarria Santos .. B66B 11/0253 187/401
2007/0248404 A1 * 10/2007 Scheer ..... B66B 11/0253 403/179
2007/0251767 A1 * 11/2007 Yoon ..... B66B 11/0226 187/401
2010/0061076 A1 * 3/2010 Mandy ..... B66B 11/0233 362/20
2010/0066248 A1 * 3/2010 Mattila ..... B66B 1/34 315/76
2012/0106138 A1 * 5/2012 Mandy ..... B66B 11/0233 362/147
2013/0220742 A1 * 8/2013 Mielonen ..... B66B 11/0206 187/401
2014/0305749 A1 * 10/2014 Manner ..... B66B 11/0226 187/401
2017/0144863 A1 * 5/2017 Minami ..... B66B 11/0226
2018/0050885 A1 * 2/2018 Fernandez ..... B66B 11/0233
2018/0208437 A1 * 7/2018 Durand ..... B66B 11/0233

FOREIGN PATENT DOCUMENTS

EP 1619158 A1 1/2006
JP H05201662 A 8/1993
JP H07206327 A 8/1995
JP 2010064891 A 3/2010
JP 2012082044 A 4/2012
JP 2014097850 A 5/2014

OTHER PUBLICATIONS

International Search Report and Written Opinion for application PCT/EP2015/054645, dated Feb. 2, 2016, 18pgs.

* cited by examiner

ELEVATOR CAR

The invention is related to an elevator car, in particular to an elevator car comprising a lighting arrangement which is configured for illuminating the elevator car's interior space.

The cars of elevators which are intended for passenger transportation need to be provided with a lighting arrangement for illuminating the elevator car's interior space providing the passenger compartment. Such an illumination is in particular necessary when the car doors are closed and the interior space is not illuminated by exterior light.

Recent developments in the design of elevator cars have increased the demands on said lighting arrangements. In consequence there is a desire for improved lighting arrangements providing enhanced structural, electrical, optical and economical characteristics, which are easy to produce, install and maintain.

According to an exemplary embodiment of the invention an elevator car, which is configured for moving along a hoistway in a vertical direction, comprises: a passenger compartment defining an interior space surrounded by sidewalls and at least one car door, wherein said sidewalls and/or said car door form at least one vertically extending corner or protrusion. At least one vertically extending decorative element is assigned to the at least one vertically extending corner or protrusion and comprises at least one vertically extending lighting element which is configured for illuminating the interior space. The decorative element and the lighting element are configured to form a lighting arrangement for illuminating the elevator car's interior space.

Such a configuration allows an easy and reliable installation of the lighting arrangement with enhanced structural, electrical, optical and economical characteristics. The decorative element further provides some protection for the lighting element preventing the lighting element from being damaged by passengers or load. The lighting arrangement provides a pleasant appearance with ergonomical illumination of the car's interior space.

Exemplary embodiments of the invention are described in the following in more detail with reference to the enclosed figures.

SHORT DESCRIPTION OF THE FIGURES

Figure 6B:
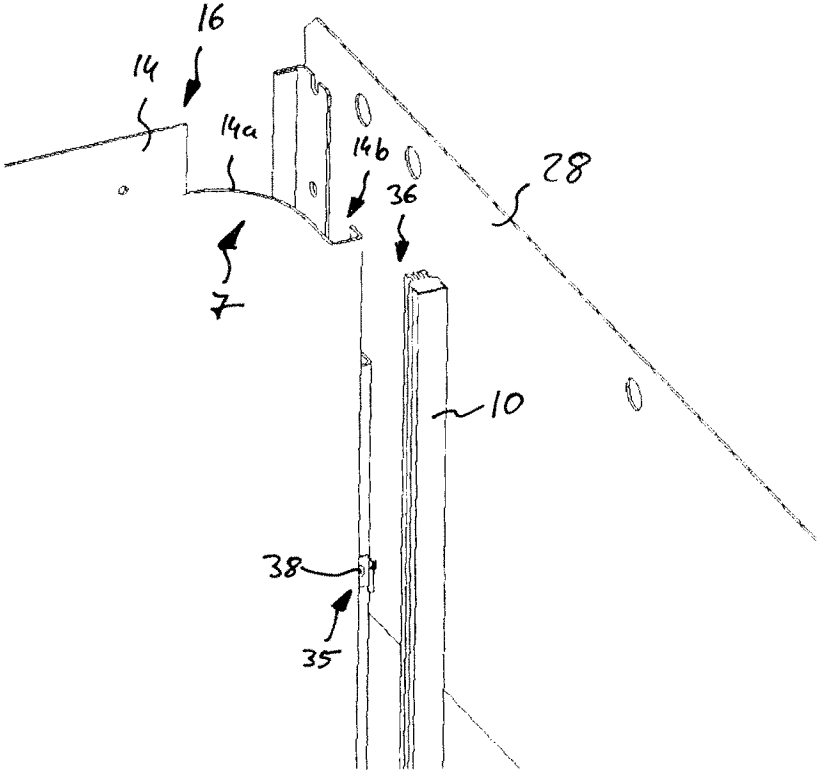
Figure 6A:
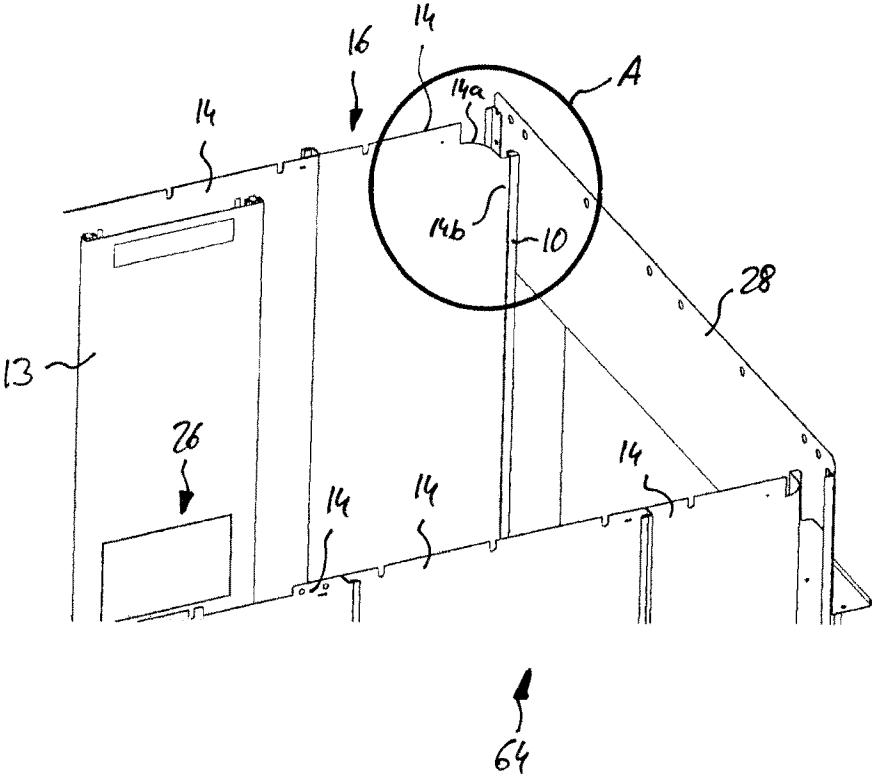

FIGS. 6*a* and 6*b* illustrate a second option of fixing the lighting element to the decorative side element.

Figure 7B:
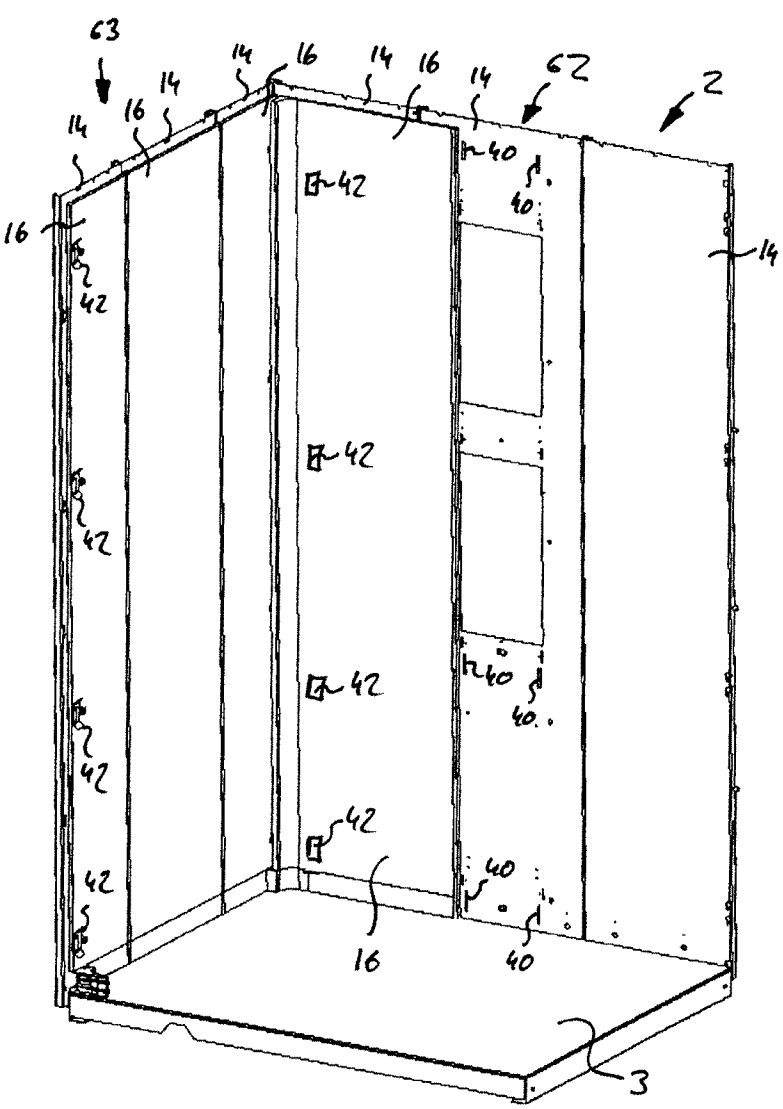
Figure 7A:
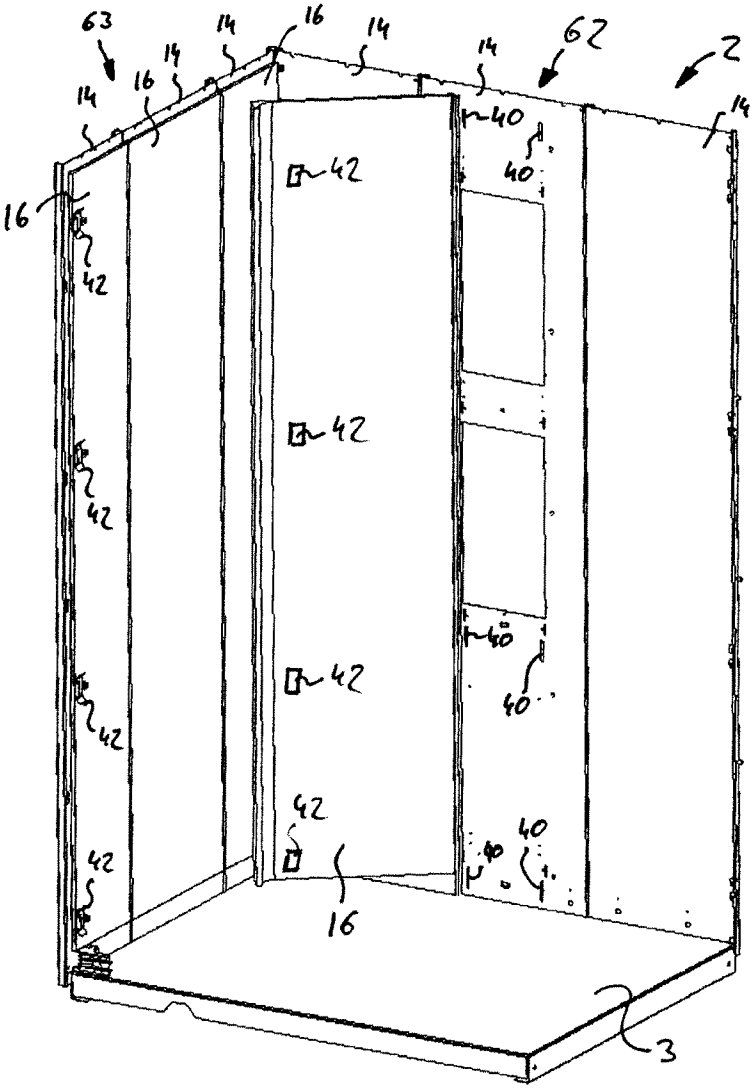

FIGS. 7*a* and 7*b* illustrate an option of fixing a decorative side element to a structural side panel.

Figure 8:
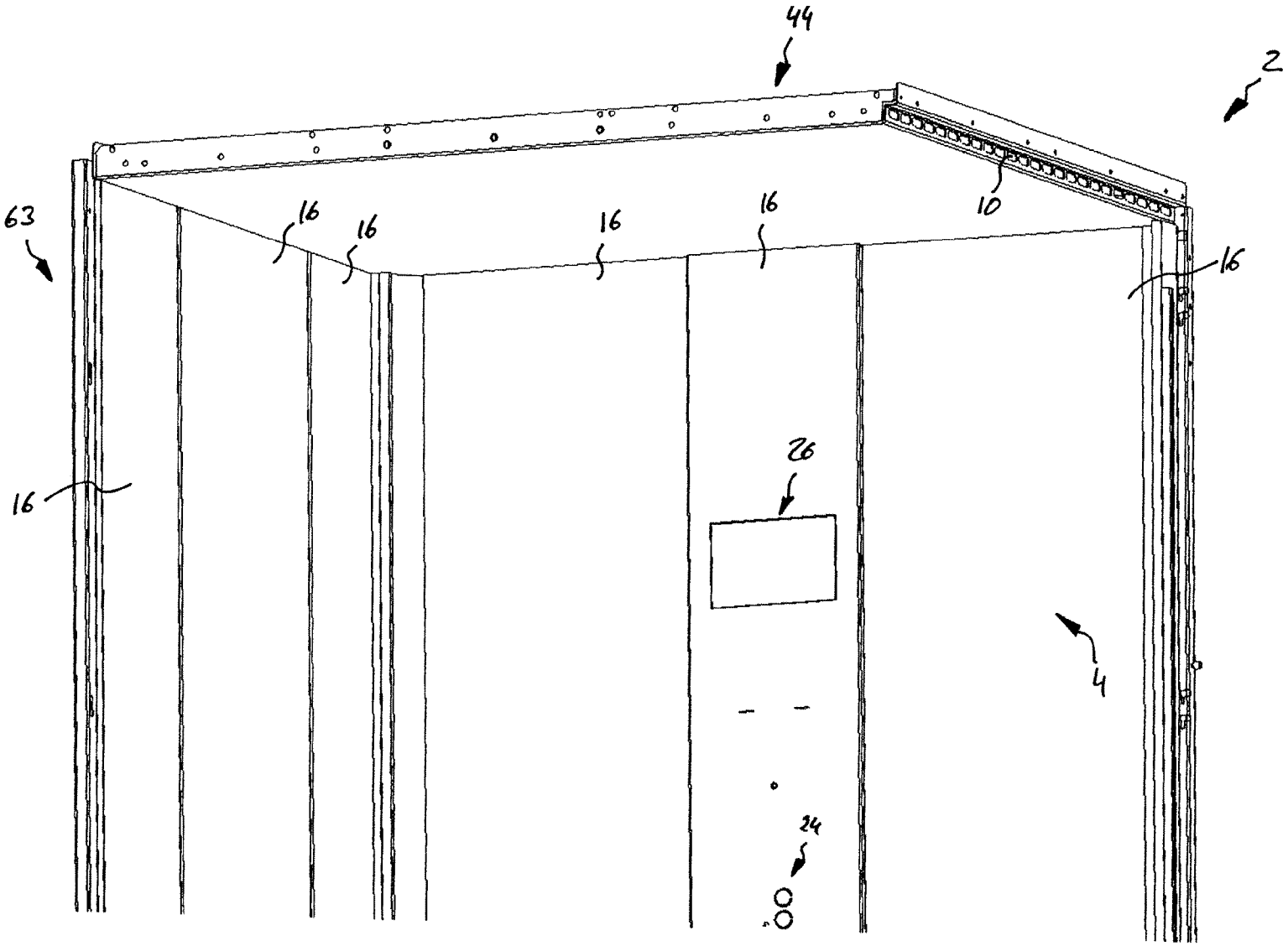

FIG. 8 illustrates an embodiment comprising a lighting element provided at the ceiling of the elevator car's interior space.

DETAILED DESCRIPTION OF THE FIGURES

Figure 1:
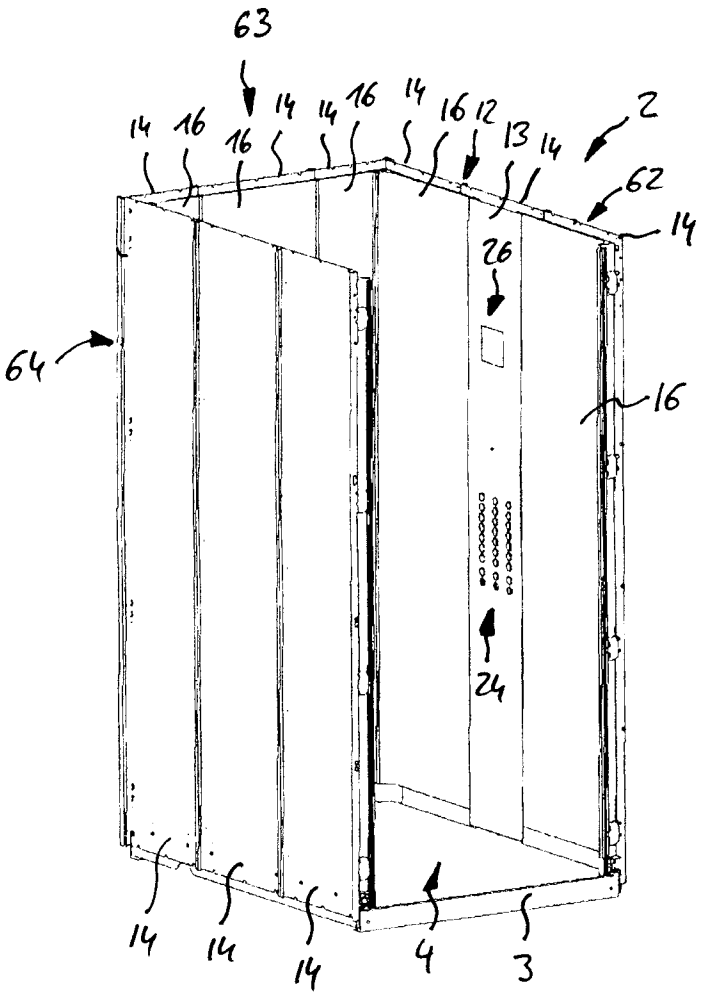
FIG. 1 shows a perspective view of an elevator car according to an exemplary embodiment of the invention.

FIG. 1 shows a perspective view of an elevator car 2 according to an exemplary embodiment of the invention.

The elevator car 2 comprises a basically horizontally oriented bottom plate 3 and three sidewalls 62, 63, 64 extending vertically upwards from the bottom plate 3 defining a prismatic interior space 4 providing the passenger compartment.

The top plate/ceiling and the front sidewall of the elevator car 2 including the car door are not shown in FIG. 1 for allowing an unobstructed view into the elevator car's interior space 4/passenger compartment.

Each of the sidewalls 62, 63, 64 is respectively formed by three structural side panels 14 arranged adjacent to each other. Of course, the number of three structural side panels 14 is only exemplary and the skilled person easily understands that an arbitrary number of structural side panels 14 may be used for forming the sidewalls 62, 63, 64.

A plurality of decorative elements 13, 16 facing the interior space 4 are arranged inside the structural side panels 14.

At least one of the decorative elements 13, 16 is provided as a decorative side element 16 and a decorative control element 13 comprising a plurality of push buttons 24 which are configured for controlling the operation of the elevator system, and a display 26 allowing to provide information related to the elevator's status, e.g. the number of the floor in which the elevator car 2 is actually located, to passengers situated within the elevator car 2.

Figure 2:
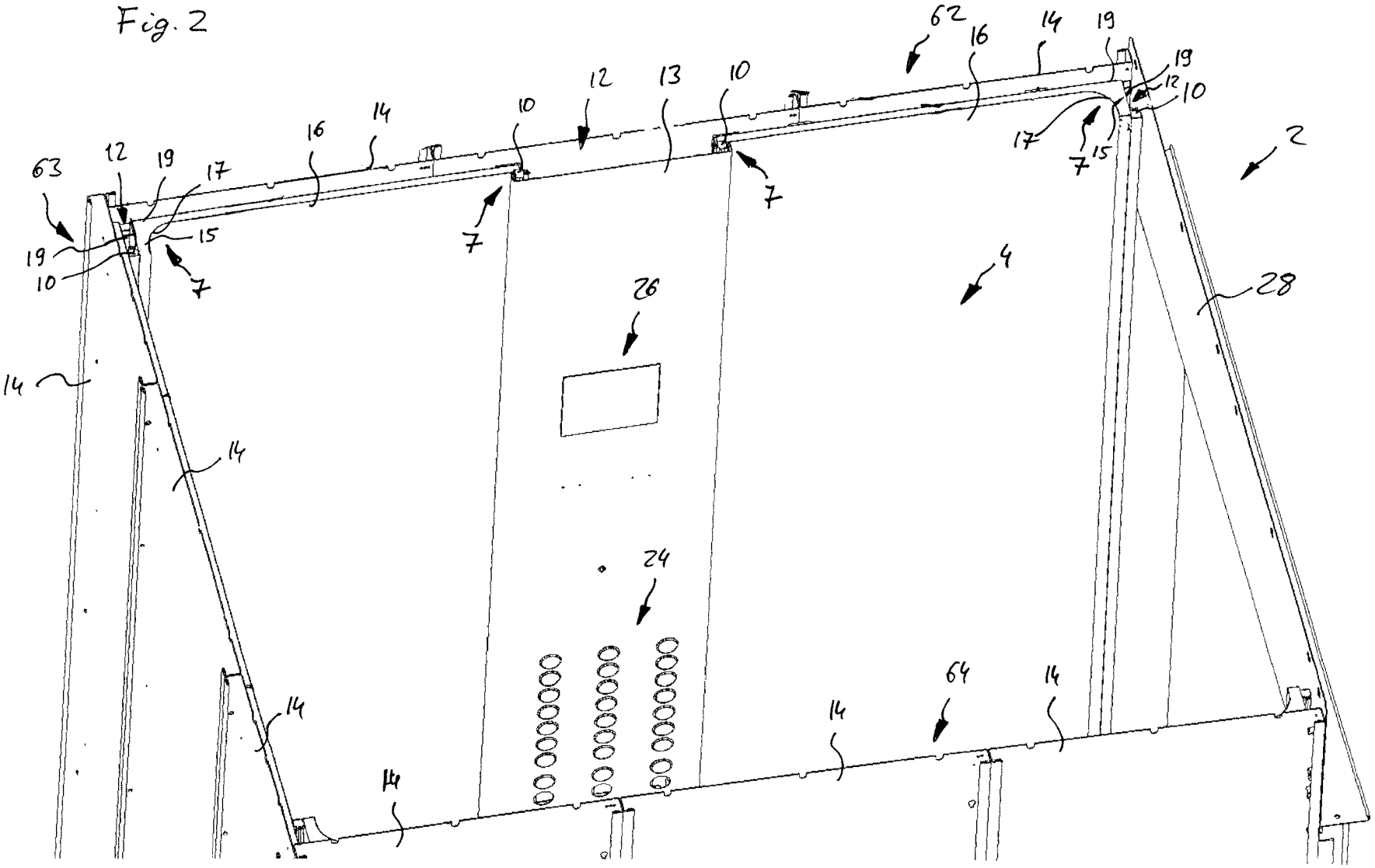
FIG. 2 shows a view from the top into the elevator car's interior.

FIG. 2 is a view from the top into the car's 2 interior space 4/passenger compartment, and in particular shows two decorative side elements 16 and the decorative control element 13, which is arranged between the two decorative side elements 16 and which comprises the plurality of push buttons 24 and the display 26.

The decorative elements 13, 16 are spaced apart from the structural panels 14 forming the sidewalls 62, 63, 64 of the elevator car 2 thereby generating an empty space 12 between the respective decorative element 13, 16 and the adjacent structural panel 14.

The lateral end portions 15 of the decorative side elements 16 respectively facing the front side of the elevator car 2 (shown on the right side of FIG. 2) comprising the car door (nor shown) and the opposing rear side (shown on the left side of FIG. 2) are tilted with respect to the decorative side elements 16 main portions, thereby forming a vertically extending corner 7 comprising two outer side portions 19, which are arranged parallel to the respective structural side panels 14, and an arcuate inner side 17 facing the car's 2 interior space 4.

A vertically extending lighting element 10 comprising at least one light source, e.g. an LED, which allows to indirectly illuminate the car's 2 interior space 4, is arranged in the space 12 provided between the tilted lateral end portion 15 of the respective decorative side element 16 and the adjacent structural side panel 14 forming the respective sidewall 63 or the frame 8 of the car door (not shown).

Figure 3:
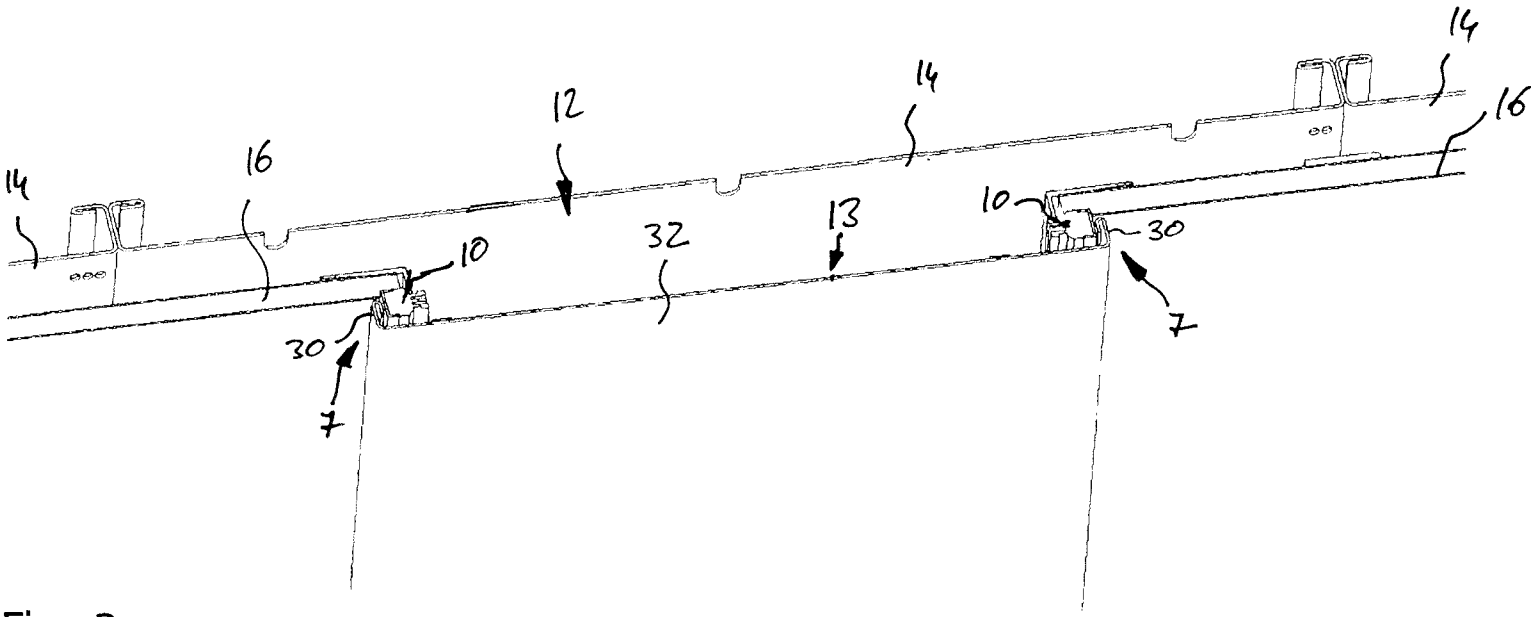
FIG. 3 shows an enlarged perspective view of the interfaces between a decorative control element and two adjacent decorative side elements.
Figure 4:
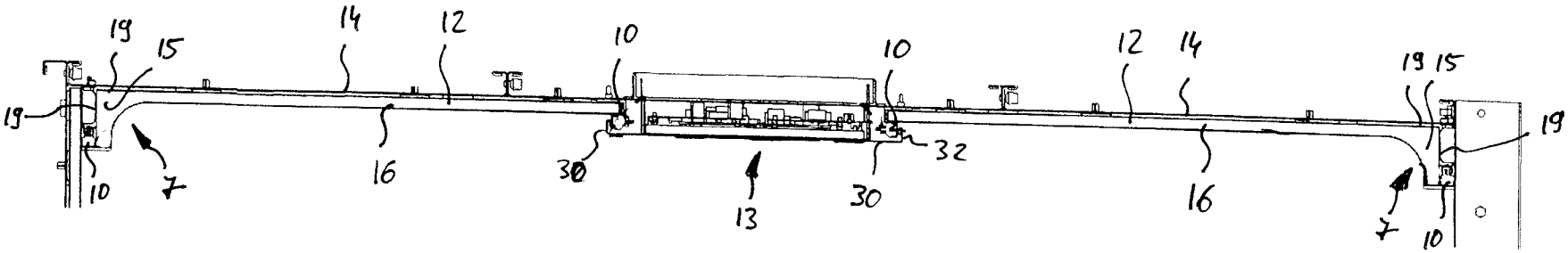
FIG. 4 shows an enlarged cross-sectional view of the interfaces between a decorative control element and two adjacent decorative side elements.

Further lighting elements 10 are provided at the interfaces between the decorative side elements 16 and the decorative control element 13, as it is shown in more detail in a perspective view in FIG. 3 and in a cross-sectional view in FIG. 4.

The decorative control element 13 comprises a planar central portion 32, which is oriented basically parallel to the adjacent structural side panel 14, and two side portions 30, which are oriented basically rectangular with respect to the planar central portion 32. The side portions 30 in particular may be formed by folding or double folding a sheet material, e.g. a metal sheet.

The side portions 30 are formed so that at least a portion of the central portion 32 overlaps with a portion of the adjacent decorative side element 16 providing a space defined by said decorative side element 16, the central portion 32 and a side portion 30 of the decorative control element 13. In this way two receiving spaces are formed, one receiving space at each lateral side of the decorative control element 13, and each receiving space being configured for accommodating at least one vertically extending lighting element 10 respectively comprising at least one light source, e.g. an LED, for illuminating the car's 2 interior space 4.

Figure 5:
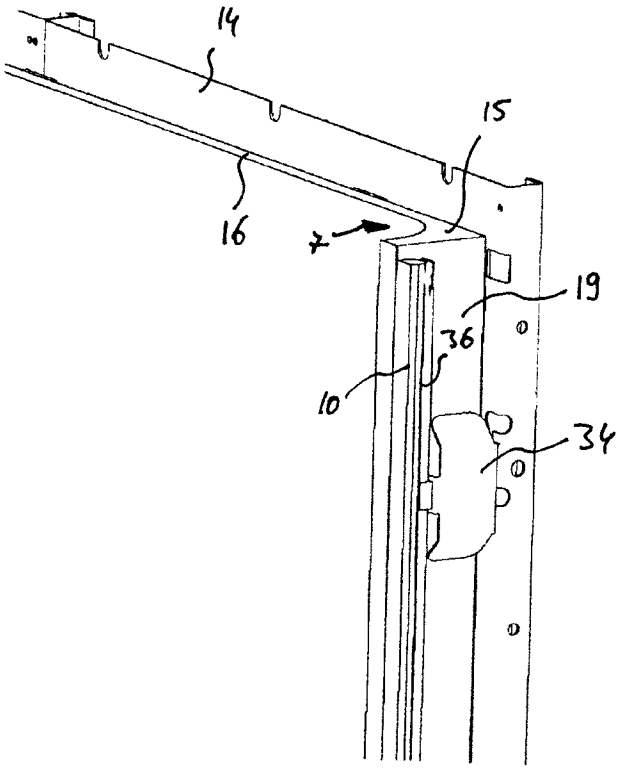
FIG. 5 illustrates a first option of fixing the lighting element to the decorative side element.

FIG. 5 shows one option of fixing the lighting element 10 to a decorative side element 16 by means of a fixing clamp 34 engaging with a corresponding fixing portion 36, which is formed at the lighting element 10. In the embodiment shown in FIG. 5, the fixing portion 36 has the form of a vertically extending groove extending along the length of the lighting element 10. The fixing clamp 34 is clamped to an outer side portion 19 of the decorative side element 16 for fixing the lighting element 10 to the decorative side element 16.

FIG. 6*a* illustrates an alternative embodiment, in which the decorative side element 16 is integrally formed by the structural side panel 14 with a vertically extending end of the structural side panel 14 being arcuately bent forming a vertically extending corner 7 of the elevator car's 2 interior space 4. The outer end portion of said arcuately bent portion 14*a* is folded twice orthogonally for providing a rectangular end portion 14*b* of the structural side panel 14.

FIG. 6*b* shows an enlarged view of the area A encircled in FIG. 6*a*.

The lighting element 10 is fixed to the decorative side element 16 by means of a bracket 35 which is configured for engaging with a fixing portion 36, e.g. a groove, provided at the lighting element 10, as well. In this embodiment, the bracket 35 is fixed to the rectangular end portion 14*b* of the structural side panel 14 by means of a screw 38.

This embodiment avoids the need for providing decorative side elements 16 in addition to the structural side panels 14 reducing the number of parts to be produced and assembled as well as the weight of the elevator car 2.

FIGS. 7*a* and 7*b* illustrate an option of fixing a decorative side element 16 to the structural side panels 14. In this embodiment the decorative side element 16 comprises a plurality of protrusions provided at one side of the decorative side element 16 along its length or height. A plurality of corresponding receiving slots 40 are formed in the structural side panels 14. For fixing the decorative side element 16 to the structural side panel 14 the protrusions of the decorative side element 16 are inserted into the corresponding slots 40 (FIG. 7*a*) and then the decorative side element 16 is pivoted into a position in which it is oriented parallel to the corresponding structural side panel 14 (FIG. 7*b*). When oriented in said second position, in which it is oriented parallel to the corresponding structural side panel 14, the decorative side element 16 is fixed to the structural side panel 14 by means of one or more fixtures 42, in particular click-and-push-fixtures 42 which are provided at the pivotable side of the decorative side element 16, i.e. the side opposed to the protrusions. If necessary, the decorative side element 16 may be removed from the structural side panel 14 easily by releasing the fixtures 42, pivoting the decorative side element 16 from the position parallel to the structural side panel 14 into an angled position, as it is shown in FIG. 7*a*, and removing the protrusions from the slots 40.

FIG. 8 finally illustrates an embodiment in which a lighting element 10 comprising an illuminated surface is provided at the ceiling 44 of the elevator car's 2 interior space 4, for illuminating the front side (not shown) of the elevator car's 2 interior space 4. Providing a lighting element 10 at the ceiling 44 of the elevator car's 2 interior space 4 allows enhancing the quality and in particular the uniformity of the lighting of the elevator car's 2 interior space 4 even further.

Optional Features:

A number of optional features are set out in the following. These features may be realized in particular embodiments, alone or in combination with any of the other features:

In one embodiment the at least one lighting element comprises at least one LED, in particular a plurality of LEDs arranged next to each other in the vertical direction. LEDs are reliable light sources which are cheap in production, operation and maintenance and produce less heat than alternative light sources.

In one embodiment the plurality of LEDs are provided in the form of at least one LED strip which is attached to the decorative element. Providing the LEDs in the form of an LED strip allows an easy and fast installation of the LEDs and facilitates the electrical wiring of the LEDs.

In one embodiment the lighting arrangement is configured for indirectly illuminating the interior space allowing to provide a pleasant light atmosphere in the car's interior space and enhancing the operational safety of the elevator by avoiding that the passengers are blinded by direct light.

In one embodiment the passenger compartment comprises at least one structural panel forming a sidewall of its interior space, the structural panel forming the decorative element. Combining the structural panel with the decorative element in a single element reduces the number of elements to be assembled and thus facilitates the assembly and allows reducing the weight of the elevator car.

In one embodiment the passenger compartment comprises at least one structural panel forming a sidewall of the interior space, the structural panel providing a mounting portion to which at least a portion of the decorative element is attached. Providing a mounting portion which is configured for attaching the decorative element facilitates the installation of the decorative element and minimizes the reductions of passenger/load space due to the installation of the decorative element.

In one embodiment the decorative element has an inner wall facing the interior space, wherein at least a portion of said inner wall is oriented basically parallel to the structural panel and/or sidewall providing a maximized interior space having a shape which is similar to the exterior shape of the elevator car.

In one embodiment the decorative element has an inner wall facing the interior space, wherein at least a portion of said inner wall is oriented basically perpendicularly to the structural panel and/or sidewall. Providing a basically perpendicular corner in the decorative element allows enhancing the rigidity of said decorative element.

In one embodiment the decorative element has an inner wall facing the interior space, wherein at least a portion of said inner wall is oriented in an angle between 0 and 90 degrees with respect to the structural panel and/or sidewall, particularly in an angle of about 45 degrees which allows to increase the decorative element's rigidity without considerably reducing the space which is available for accommodating passengers and/or load and reducing the risk of passengers being hurt when contacting the decorative element.

In one embodiment the decorative element has an inner wall facing the interior space, wherein at least a portion of said inner wall is arcuate allowing increasing the decorative element's rigidity without considerably reducing the space available for accommodating passengers and/or load and reducing the risk of passengers being hurt when contacting the decorative element.

In one embodiment the decorative element comprises any of a metal sheet, a metal-plastics composite panel, or a veneer.

In one embodiment the decorative element comprises a metal sheet, wherein at least a portion of the metal sheet is folded, in particular forming at least a portion of the decorative element by a double layer of the metal sheet providing a high stability/rigidity. Folding provides an easy method of forming a suitable decorative element from a sheet of metal.

In one embodiment the decorative element is attached to the structural panel forming a sidewall of the passenger compartment by means of at least one hook and loop fastener. Hook and loop fasteners allow an easy and cheap installation and de-installation, if necessary, of the decorative elements.

In one embodiment the decorative element is attached to the structural panel forming a sidewall of the passenger compartment by means of at least one slot formed in the structural panel and at least one corresponding protrusion formed at the decorative element, the protrusion being configured to be received by the slot for pivotably connecting the decorative element to the structural panel. The decorative element may further comprise a fixture for fixing the pivotable end of the decorative element to the structural panel.

In one embodiment the lighting element is fixed to a decorative element by means of a clamp or bracket providing a reliable but detachable fixture.

In one embodiment the elevator car comprises a plurality of corners or protrusions with a decorative element being assigned to each of said corners or protrusions, respectively, allowing an enhanced and in particular uniform lighting of the elevator car's interior space.

In one embodiment the lighting arrangement for illuminating the elevator car's interior space further comprises an illuminated surface forming at least part of the ceiling of the interior space, which allows enhancing the quality and in particular the uniformity of the lighting of the elevator car's interior space even further.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention include all embodiments falling within the scope of the dependent claims.

REFERENCES

2 elevator car
3 bottom plate
4 interior space
7 vertically extending corner
8 car door frame
10 lighting element
12 empty space
13 decorative control element
14 structural side panel
14*a* arcuately bent portion of the structural side panel
14*b* rectangular end portion of the structural side panel
15 lateral end portion
16 decorative side element
17 inner side
19 outer side portion
24 plurality of push buttons
26 display
30 side portion of the decorative control element
32 central portion of the decorative control element
34 clamp
35 bracket
36 fixing portion
38 screw
40 slot
42 fixture
44 ceiling 62, 63, 64 sidewalls

The invention claimed is:

1. An elevator car, which is configured for moving along a hoistway in a vertical direction and comprises:

a passenger compartment defining an interior space surrounded by side-walls and at least one car door, said sidewalls and/or said car door forming at least one vertically extending corner or protrusion;

wherein at least one vertically extending decorative element joins the at least one vertically extending corner or protrusion and comprises at least one vertically extending lighting element which is configured for illuminating the interior space;

wherein the passenger compartment comprises at least one structural panel forming a sidewall of the interior space, the structural panel providing a mounting portion to which at least a portion of the decorative element is attached;

wherein the decorative element is attached to the structural panel forming at least one of the sidewalls of the passenger compartment by means of at least one slot formed in the structural panel and at least one corresponding protrusion formed at the decorative element, the protrusion being configured to be received by the slot for pivotably connecting the decorative element to the structural panel.

2. The elevator car according to claim 1, wherein the at least one vertically extending lighting element comprises at least one LED.

3. The elevator car according to claim 2, wherein the at least one LED comprises a plurality of LEDs.

4. The elevator car according to claim 1, wherein the decorative element comprises any of a metal sheet, a metal-plastics composite panel, or a veneer.

5. The elevator car according to claim 4 wherein the decorative element comprises a metal sheet and at least a portion of the metal sheet is folded, in particular forming at least a portion of the decorative element by a double layer of the metal sheet.

6. The elevator car according to claim 1, wherein the decorative element further comprises a fixture for fixing the pivotable end of the decorative element to the structural panel.

7. The elevator car according to claim 1, wherein the at least one vertically extending lighting element is fixed to the decorative element by means of a clamp or bracket.

8. The elevator car according to claim 1, further comprising an illuminated surface forming at least part of the ceiling of the interior space.

* * * * *